US008707592B2

(12) United States Patent
Heinz et al.

(10) Patent No.: US 8,707,592 B2
(45) Date of Patent: Apr. 29, 2014

(54) SPIRAL WRAPPING FOR AN IRONER ROLLER OF A CHEST IRONER AND A CHEST IRONER PROVIDED WITH SUCH A SPIRAL WRAPPING

(75) Inventors: Engelbert Heinz, Vlotho (DE); Wilhelm Bringewatt, Porta Westfalica (DE); Ted Andrews, Altham (GB)

(73) Assignee: Herbert Kannegiesser GmbH, Vlotho (DE)

( * ) Notice: Subject to any disclaimer, the term of this patent is extended or adjusted under 35 U.S.C. 154(b) by 18 days.

(21) Appl. No.: 13/364,666

(22) Filed: Feb. 2, 2012

(65) Prior Publication Data

US 2012/0198736 A1 Aug. 9, 2012

(30) Foreign Application Priority Data

Feb. 4, 2011 (DE) ..... 10 2011 010 426

(51) Int. Cl.
*D06F 67/02* (2006.01)
*F28F 5/02* (2006.01)

(52) U.S. Cl.
USPC ..... 38/66; 492/43

(58) Field of Classification Search
USPC ..... 38/14–18, 44–66; 492/48, 43
See application file for complete search history.

(56) References Cited

U.S. PATENT DOCUMENTS 1,432,940 A * 10/1922 Yates ..... 38/63
1,468,557 A * 9/1923 Cline ..... 38/63
1,973,044 A * 9/1934 Brann ..... 492/51
2,033,894 A * 3/1936 Crockford ..... 492/43
2,264,731 A * 12/1941 Wakem ..... 38/63
2,272,238 A * 2/1942 Castricone ..... 492/43
2,499,015 A * 2/1950 Baker ..... 492/48
2,669,003 A * 2/1954 Obitz ..... 38/63
2,672,678 A * 3/1954 Forman ..... 492/43
2,686,377 A * 8/1954 Case ..... 38/11
3,057,179 A * 10/1962 Willingham, Jr. ..... 66/192
3,097,442 A * 7/1963 Willingham, Jr. ..... 38/66
3,911,603 A 10/1975 Lehrman
4,603,494 A 8/1986 Lehrman
6,836,984 B2 * 1/2005 Vanderheyden ..... 38/66
2002/0065008 A1 5/2002 Stanhope

OTHER PUBLICATIONS

European Patent Office Search Report on related application EP 12000402 (May 23, 2013).

* cited by examiner

*Primary Examiner* — Ismael Izaguirre
(74) *Attorney, Agent, or Firm* — Laurence P. Colton; Smith Risley Tempel Santos LLC

(57) ABSTRACT

A spiral wrapping for an ironer roller for a chest ironer. Chest ironers have at least one rotatably drivable ironer roller, the lower half of which is surrounded by a stationary ironer bed. The ironer roller is surrounded by an outer spiral wrapping which comes into contact with the item of laundry to be treated. The spiral wrapping is provided with an outer layer produced from a coarse woven fabric which has a higher coefficient of friction. The coefficient of friction of the coarse woven fabric does not alter as the age of the spiral wrapping increases. This means that even in the case of older spiral wrappings, there is sufficient frictional engagement between the spiral wrapping, namely the outer layer, and the item of laundry to be smoothed out.

26 Claims, 7 Drawing Sheets

SPIRAL WRAPPING FOR AN IRONER ROLLER OF A CHEST IRONER AND A CHEST IRONER PROVIDED WITH SUCH A SPIRAL WRAPPING

STATEMENT OF RELATED APPLICATIONS

This patent application claims convention priority on and the benefit of German Patent Application No. 10 2011 010 426.7 having a filing date of 4 Feb. 2011.

BACKGROUND OF THE INVENTION

1. Technical Field

The invention relates to a spiral wrapping for an ironer roller of an ironer bed, namely a spiral wrapping for an ironer roller of a chest ironer, said spiral wrapping comprising a fiber layer which is arranged at least in one layer around the ironer roller or around a spring system which is supported by the ironer roller. In addition, the invention relates to a chest ironer having a spiral wrapping for smoothing out items of laundry, namely, a chest ironer for smoothing out items of laundry, said chest ironer comprising at least one ironer roller which has a cylindrical surface area and one ironer bed associated with each ironer roller, wherein the surface area of the respective ironer roller is provided with an outer spiral wrapping and a spring system which has springs is provided, where applicable, between the surface area of the respective ironer roller and the spiral wrapping.

2. Prior Art

Chest ironers, in particular for commercial laundries, have at least one rotatably drivable ironer roller which is provided with a spiral wrapping on the outer circumference. In many cases a bottom spiral wrapping is provided underneath the spiral wrapping, that is to say between the spiral wrapping and the outer surface of the ironer roller. Said bottom spiral wrapping consists of at least one belt band which is placed around the ironer roller and has a plurality of springs. The bottom spiral wrapping is consequently also referred to as a "spring system". In the case of chest ironers with a spring system, said surrounding outer spiral wrapping is also referred to as a top spiral wrapping. When the term "spiral wrapping" is used below, this includes the top spiral wrapping of an ironer roller that has a spring system.

The spiral wrapping or also the top spiral wrapping is formed from a fiber material, as a rule a felt, in particular a needled felt, or a nonwoven fabric. These fiber materials are formed from thermally stable plastics material fibers, for example aramid fibers. They form a fiber layer which comes into contact with the laundry to be smoothed out. During the ironing process, the items of laundry, entrained by the rotatably drivable ironer roller, are moved slidingly along a stationary smoothing surface of an ironer bed which surrounds the lower half of the ironer roller. To this end, the items of laundry have to be entrained in a frictionally engaged manner by the rotating ironer roller. To ensure this, the outer side of the spiral wrapping coming into contact with the laundry has to have a correspondingly high frictional value or coefficient of friction. It has been shown that the frictional value of the fiber layer diminishes over time by the outer side of the fiber layer that comes into contact with the items of laundry becoming smoother over time. The result of this is that reliable entrainment of the items of laundry by the rotatably drivable ironer roller is no longer ensured, above all the contact force between the ironer roller and the ironer bed associated therewith has to be reduced, as a result of which the ironing performance declines.

BRIEF SUMMARY OF THE INVENTION

The object underlying the invention is to create a chest ironer and a spiral wrapping which guarantees a lasting effective frictional engagement with the items of laundry to be ironed.

A spiral wrapping to achieve this object is a spiral wrapping for an ironer roller of a chest ironer, said spiral wrapping comprising a fiber layer which is arranged at least in one layer around the ironer roller or around a spring system which is supported by the ironer roller, wherein an uncovered outer side of the fiber layer has associated therewith an outer layer with a coefficient of friction which is greater in comparison with that of the fiber layer. By the spiral wrapping being formed from the usual fiber layer and an additional outer layer with a frictional value that is greater than that of the fiber layer, the result is better adhesiveness and/or coarseness of the outer layer which forms the outer surface of the spiral wrapping. This generates increased frictional engagement between the ironer roller and the items of laundry to be entrained by said roller. The outer layer having a higher frictional value also guarantees sufficient frictional engagement between the spiral wrapping and the items of laundry even in the case of an older spiral wrapping.

The frictional value of the outer layer is preferably greater compared to that of the fiber layer at least on the surface that faces the items of laundry. This means that the coefficient of friction of the surface of the outer layer is increased. This leads to the items of laundry gripping the outer layer of the spiral wrapping according to the invention in a better manner.

It is preferably provided that at least one transverse edge of the outer layer which extends parallel to the axis of rotation of the ironer roller is connected to the fiber layer. It is particularly advantageous to sew up at least the at least one transverse edge of the outer layer to the fiber layer. In an advantageous manner, the sewing is effected using a plastics material thread made of polytetrafluoroethylene (PTFE). The connection between the outer layer and the fiber layer leads to both layers essentially remaining together and consequently cooperating during the operation of the chest ironer.

A preferred further development of the spiral wrapping provides that the outer layer is connected to the fiber layer over the entire surface. This can be effected in different ways, for example by means of gluing and/or sewing up. In this way, slippage between the two layers is avoided in a particularly effective manner. In this way, in particular, the outer layer which has a higher frictional value is prevented from slipping with respect to the fiber layer which has a frictional value which is lower compared to that of the outer layer.

A preferred development of the spiral wrapping provides that the length of the outer layer is only half that of the fiber layer. As a rule, the length of the outer layer will be somewhat longer than half the length of the fiber layer so that the ends of the outer layer completely surround the fiber layer and its transverse edges slightly overlap. If the term "half the length" is used below, this always means approximately half the length and preferably somewhat more than half the length.

If the outer layer is approximately half the length of the fiber layer, a length of the fiber layer corresponds approximately to double the circumference of the ironer roller or of the spring system of the same, preferably is somewhat longer. The fiber layer then goes around the ironer roller twice such that it has two layers, whilst the outer layer only goes around the outer side of the fiber layer once completely or with a slight overlap. This ensures that the spiral wrapping is sufficiently flexible through the two-layered fiber layer, but the spiral wrapping is surrounded on the outside right around by the outer layer, which has a coefficient of friction which is greater than that of the fiber layer.

As an alternative, the spiral wrapping can also be realized such that the fiber layer and the outer layer are approximately the same length. The lengths of the fiber layer and of the outer layer then preferably correspond approximately to the outer circumference of the ironer roller or of its bottom spiral wrapping or spring system. In this case, both the fiber layer and the outer layer, which has a higher frictional value, go around the ironer roller once completely and therefore form, in each case, a single-layer covering on the ironer roller, at least the transverse edges of the outer layer overlapping slightly on at least one seam.

Another advantageous development of the spiral wrapping provides that said spiral wrapping or its outer layer is composed of several identical, in particular identically-sized part spiral wrappings or outer layer parts. The spiral wrapping is preferably composed of two identical or identically-sized part spiral wrappings. The fiber layer and/or the outer layer then, in each case, only wraps around part of the circumference of the ironer roller. The fiber layer and/or the outer layer of all the part spiral wrappings together then wrap around the ironer roller at least once completely. The part spiral wrappings, at least the outer layer of which surrounds the ironer roller in an only partial manner, create shorter sections of the spiral wrapping which make it possible for changes in length, in particular elongations, of the part spiral wrappings, in particular of their outer layers, to be automatically restored in an easier manner and above all in a complete manner in the regions of the circumference of the ironer roller not occupied by any item of laundry. This means that a disadvantageous permanent lengthening of the spiral wrapping is avoided in a reliable manner.

It is preferably provided in the case of the spiral wrapping which is composed of several part spiral wrappings that the fiber layer of the respective part spiral wrapping completely surrounds the ironer roller, but the outer layer surrounds only part of the ironer roller, preferably half of it. It is conceivable then that the fiber layer completely surrounds the ironer roller, but not the outer layer which has a higher frictional value and which is then composed of the shorter outer layers of several part spiral wrappings. In particular if, according to a preferred development of the invention, the outer layer is thinner than the fiber layer such that, above all, the outer layer, also on account of the higher coefficient of friction, stretches more than the thicker fiber layer when an item of laundry moves along the ironer bed, it is sufficient to form only the outer layer from several parts, whilst the fiber layer wraps around the ironer roller completely or, where applicable, even repeatedly.

A further alternative advantageous development of the spiral wrapping provides that the length of the fiber layer and of the outer layer of each part spiral wrapping are approximately the same length, both the fiber layer and the outer layer surrounding the ironer roller only in part, in particular approximately half of it. In this case, the entire part spiral wrapping still extends over part of the circumference of the ironer roller. After being elongated when items of laundry are moved along the ironer bed, the part spiral wrappings which, in this manner, are only quite short, are restored again in an easy and above all complete manner into the non-stretched starting position. This leads to the entire spiral wrapping of the ironer roller or the spring system of the ironer roller fitting in a permanently reliable manner.

A development of the spiral wrapping is also conceivable where the length of the fiber layer corresponds approximately to double the circumference of the ironer roller, whilst the outer layer extends only over half the length of the fiber layer. The fiber layer then surrounds the ironer roller or the spring system of the same two times, that is to say can be wrapped around the ironer roller in two layers, whilst the outer layer, the frictional value of which is higher compared to that of the fiber layer, surrounds the ironer roller or the fiber layer only once. In this way, a spiral wrapping which is constructed in a particularly simple manner and is, above all, very flexible as a result of the double-layer fiber layer is created.

In the case of a preferred development of the spiral wrapping, it is provided to form the outer layer from a woven fabric, preferably a coarse woven fabric. Such woven fabrics, in particular coarse woven fabrics, have a surface with a high frictional value or coefficient of friction which does not diminish or only diminishes in a negligible manner as the age of the spiral wrapping increases, unlike the felt or nonwoven fabric from which the respective fiber layer is formed. It is particularly advantageous to form the fibers of the woven fabric or coarse woven fabric from plastics material. Such plastics material fibers which have the thermal stability necessary for chest ironers are used. In addition, it is provided in an advantageous manner that the outer layer is thinner than the fiber layer. For example, the thickness of the outer layer, which has a higher coefficient of friction, can correspond to only 1/10 to half of the thickness of the fiber layer. The elasticity or flexibility of the spiral wrapping, in particular of the at least single-layer fiber layer, is negligibly impaired by the thin outer layer. In addition, it is conceivable that for forming the woven fabric or the coarse woven fabric, the cross section of the fibers, in particular of the plastics material fibers, is out-of-round. Arbitrary out-of-round cross sections are considered. Where the cross sections of the threads or fibers are polygonal, it is also conceivable for the individual part surfaces to spring back such that quasi star-shaped cross sections are created.

A chest ironer to achieve the aforementioned object is a chest ironer for smoothing out items of laundry, said chest ironer comprising at least one ironer roller which has a cylindrical surface area and one ironer bed associated with each ironer roller, wherein the surface area of the respective ironer roller is provided with an outer spiral wrapping and a spring system which has springs is provided, where applicable, between the surface area of the respective ironer roller and the spiral wrapping, wherein the spiral wrapping is formed from a fiber layer and an outer layer which covers said fiber layer on the outside and has a coefficient of friction which is greater than that of the fiber layer. In the case of said chest ironer, it is provided that the spiral wrapping is formed from a fiber layer and a preferably woven outer layer which covers said fiber layer on the outside and has a frictional value that is greater than that of the fiber layer. This means that the outer side of the spiral wrapping, which comes into contact with the items of laundry, is more adherent or rougher such that there is better frictional engagement with the items of laundry which are to be entrained by the rotatably drivable ironer roller and, even in the case of an older spiral wrapping, this does not diminish as severely as is the case with the fiber layer produced from felt or nonwoven fabric.

Preferred further developments of the chest ironer are distinguished by developments of the spiral wrapping according to one or more of the appended claims.

BRIEF DESCRIPTION OF THE DRAWINGS

Particularly advantageous exemplary embodiments of the invention are explained below by way of the drawing, in which, in detail.

DETAILED DESCRIPTION OF PREFERRED EMBODIMENTS

Figure 1:
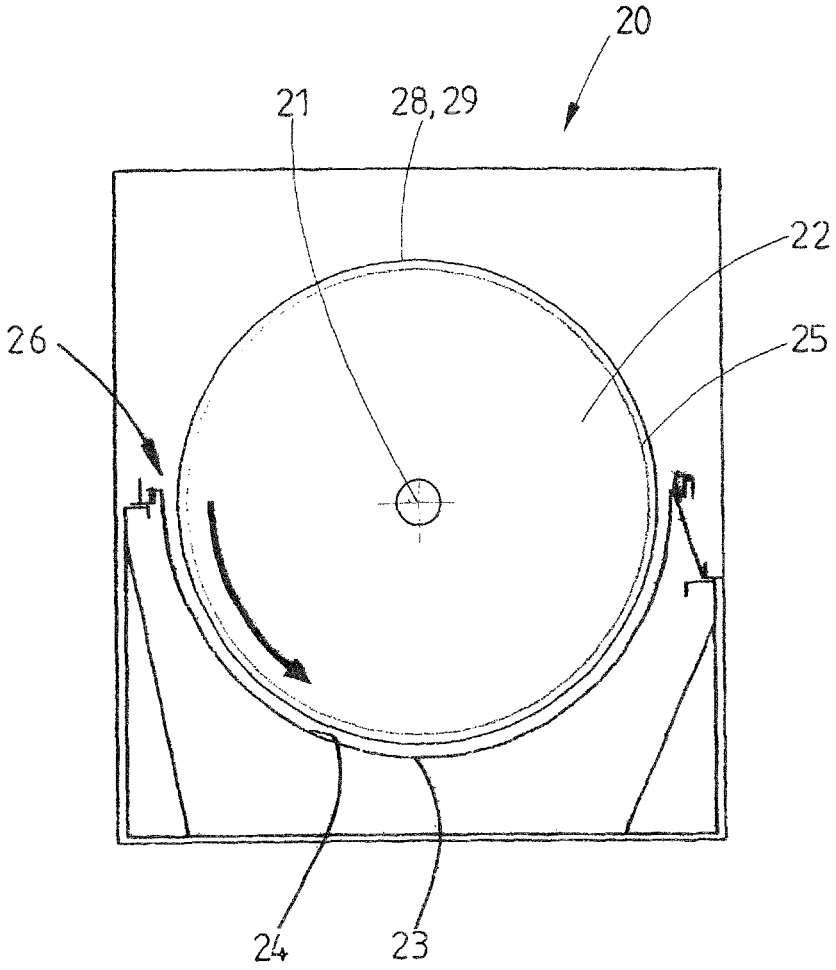
FIG. 1 shows a schematic cross section through a chest ironer.

FIG. 1 shows a schematic representation of a chest ironer 20 in particular for commercial laundries, said chest ironer being provided with one of the spiral wrappings which are described in more detail below.

The chest ironer 20 shown here has just one single ironer roller 22 which is rotatably drivable about a horizontal axis of rotation 21. Approximately the lower half of the ironer roller 22 is surrounded by a stationary, but preferably flexible ironer bed 23. The approximately semicircular ironer bed 23 is heatable in a manner that is known per se. Between the inner side of the ironer bed 23 forming a smoothing surface 24 and the outer surface area 25 of the ironer roller 22 there is an ironer gap 26, which, for the purposes of better perceptibility, is shown wider in FIG. 1 than it actually is. The item of laundry, not shown in the Figures, is moved through the ironer gap 26 when being smoothed out by the chest ironer 20. Accordingly, contrary to the representation shown in FIG. 1, the width of the ironer gap 26 is only small, which is sufficient to move an item of laundry through the ironer gap 26.

The item of laundry to be smoothed out in each case is moved through the ironer gap 26 entrained by the rotatably driven ironer roller 22 and at the same time is moved slidingly along the heated smoothing surface 24 on the inner side of the ironer bed 23.

The spiral wrappings according to the invention are suitable not only for the chest ironer 20 shown in the Figures with only one ironer roller 22 and an ironer bed 23 associated therewith, but also for chest ironers with several consecutive ironer rollers 22 and one ironer bed 23 associated with each ironer roller 22.

FIGS. 2 to 13 show different exemplary embodiments of the spiral wrapping according to the invention for the ironer roller 22 of the chest ironer 20. In FIGS. 2 to 13, the thickness of the spiral wrappings is shown to be greater compared to the diameter of the ironer roller 22. In reality, the thickness of the spiral wrapping in relation to the diameter of the ironer roller 22 is considerably smaller than shown in the Figures.

Figure 2:
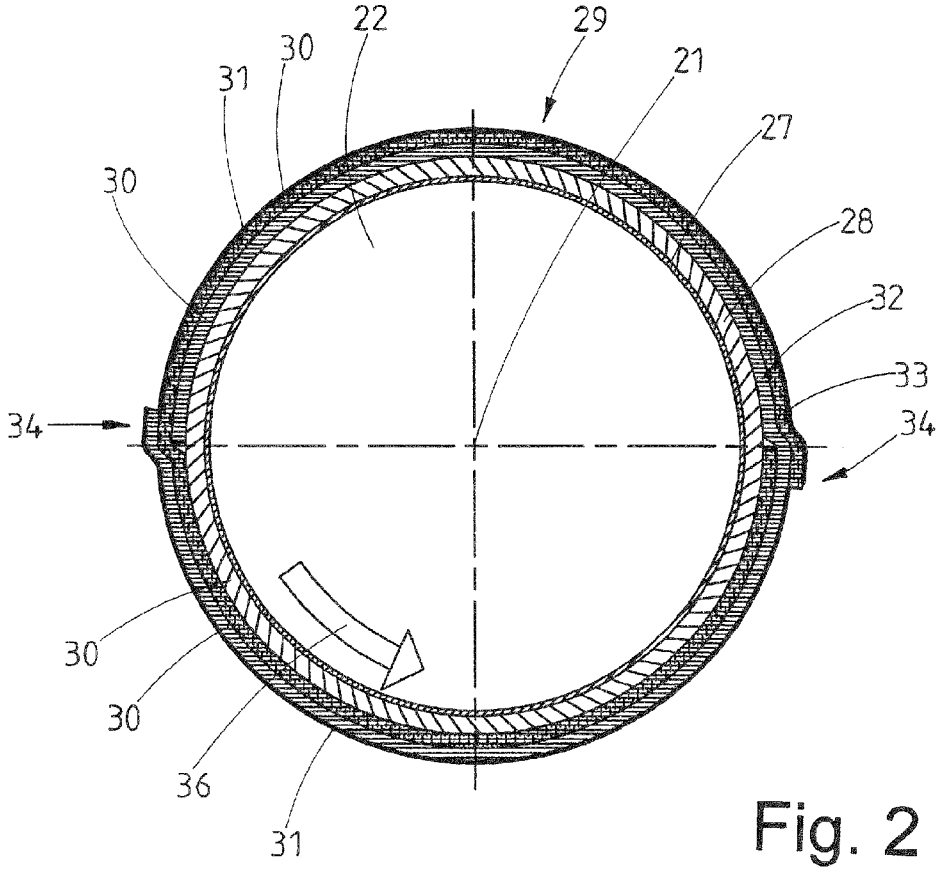
FIG. 2 shows a cross section through an ironer roller of the chest ironer of FIG. 1 with an enlarged representation of the spiral wrapping of the invention.

In FIG. 2 a spring system 28, which is produced from a plurality of springs arranged preferably on a belt band wrapped around the outer surface 27 of the ironer roller 22, is provided around the cylindrical outer surface 27 of the ironer roller 22. The spring system 28 can also be referred to as the bottom spiral wrapping.

Around the spring system 28 is arranged the spiral wrapping according to the invention, which, on account of having the spring system 28 arranged underneath it, can also be referred to as the top spiral wrapping. It is also possible to arrange the spiral wrapping 29 directly on the outer surface 27 of the ironer roller 22. In this case, the ironer roller 22 does not have a spring system 28.

According to the invention, the spiral wrapping 29 is realized in multiple layers. It has a bottom fiber layer 30 and an outer layer 31 which is arranged on top of said bottom layer. The outer layer 31 covers the fiber layer 30 over the entire circumference of the ironer roller 22. The outer layer 31 is realized in this manner, in particular is produced from such a material that it has a frictional value or coefficient of friction that is greater when compared to that of the fiber layer 30, as a result of which the outer layer 31, coming into contact with the items of laundry, preferably becomes rougher and/or the items of laundry do not slip so easily on the outer side of the spiral wrapping 29, namely its outer layer 31. In other words, the outer layer 31 is more slip defied or has a top surface that is more slip defied than the fiber layer 30. Consequently, the outer layer 31 confers a better grip on the items of laundry, as a result of which the spiral wrapping 29 according to the invention ensures greater or better frictional engagement between the ironer roller 22 and the item of laundry entrained in each case by said roller during the rotating drive. In particular, the result of the outer layer 31 is that as the age of the spiral wrapping 29 increases, the frictional value does not diminish or does not diminish as severely as would be the case if the fiber layer 30 was not covered by an outer layer 31.

Figure 3:
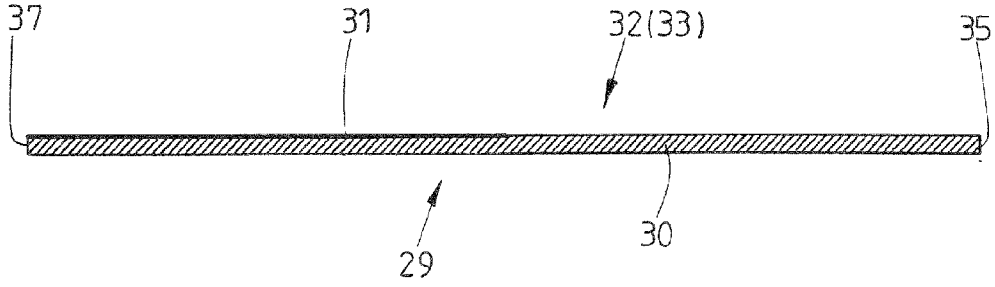
FIG. 3 shows a developed view of the spiral wrapping of FIG. 2.

The spiral wrapping 29 of FIGS. 2 and 3 is realized in two parts, namely is produced from preferably two identical, in particular identically-sized, spiral wrapping parts 32 and 33. FIG. 3 shows a developed view of one of the spiral wrapping parts, namely the spiral wrapping part 32. The spiral wrapping part 33 is realized in the same way. A length of the spiral wrapping part 32, when viewed in the circumferential direction of the outer surface 27 of the ironer roller 22, corresponds to the diameter of the ironer roller 22. In the exemplary embodiment shown, this is the outside diameter of the spring system 28. In reality, the length of the fiber layer 30 is slightly longer than the circumference of the ironer roller 22 or the outer side of the spring system 28 in order to be able to produce an overlap 34 at the points the seam connects to the other spiral wrapping part 33. If, below, length specifications are given with reference to the circumference of the ironer roller 22, this always means the outer circumference of the spring system 28 and a small oversize for producing the overlap 34. As a result, the length of the fiber layer 30 of the spiral wrapping part 33 is preferably always somewhat greater than the circumference of the ironer roller 22 on the outer side of the spring system 28.

As further shown in FIG. 3, a length of the outer layer 31 is shorter, namely only extends over approximately half the length of the fiber layer 30, that is to say half the circumference of the ironer roller 22 (plus the overlap 34). The width of the spiral wrapping 29 in the direction of the axis of rotation 21 of the ironer roller 22 is selected such that it corresponds to the width of the ironer roller 22, that is to say completely covers the outer surface 27 of the ironer roller 22 or the outer surface of the spring system 28.

The outer layer 31 is connected, for example by means of sewing, to the fiber layer 30 at least in the region of a transverse edge which extends parallel to the axis of rotation 21, preferably also to a transverse edge 37 of said fiber layer. As an alternative to this or in addition, further connections between the outer layer 31 and the fiber layer 30 can be provided. It is also conceivable to connect, by means of gluing, sewing or the like, the outer layer 31 to the fiber layer 30 over the entire surface only or in addition to the connection of the transverse edges.

The two spiral wrapping parts are wrapped one after the other around the spring system 28 on the outer surface 27 of the ironer roller 22 to produce the spiral wrapping 29. To this end, proceeding from the transverse edge 35 which does not have an outer layer 31 associated therewith, each spiral wrapping part 32, 33 is wound around the ironer roller 22 from diametrically opposite positions of the same in opposition to the direction of rotation of the ironer roller 22 indicated by the arrow 36. Once each spiral wrapping part 32, 33 is wrapped around half the circumference of the ironer roller 22, it overlaps the fiber layer 30 of the other spiral wrapping part 32, 33 in a semicircular manner. As a result, the spiral wrapping 29 obtains a double layer fiber layer 30. Once each spiral wrapping part 32, 33 is placed half around the ironer roller 22 by way of the outer side not covered by the outer layer 31, when the spiral wrapping part 32, 33 is subsequently placed about the second half of the ironer roller 22, the fiber layer 30 of the other spiral wrapping part 32, 33 covers the side that is not provided with an outer layer 31. At the same time, the outer layer 31 of each spiral wrapping part 32, 33 comes to rest on the outer side of the spiral wrapping 29 or of the ironer roller 22. By assembling the spiral wrapping 29 from two spiral wrapping parts 32, 33 with only one outer layer 31 that extends over half the length, the outer layers 31 of the two spiral wrapping parts 32, 33 complement each other to form one outer layer 31 which completely surrounds the ironer roller 22. As a result, the ironer roller 22 is completely surrounded by the outer layer 31 of the spiral wrapping 29 which has a higher coefficient of friction.

The transverse edges 37, from each of which the outer layer 31 proceeds are connected to the winding of the fiber layer 30 located underneath in the regions of the opposite overlaps 34. This can be effected in a suitable manner by means of gluing, clamping or the like.

Figure 4:
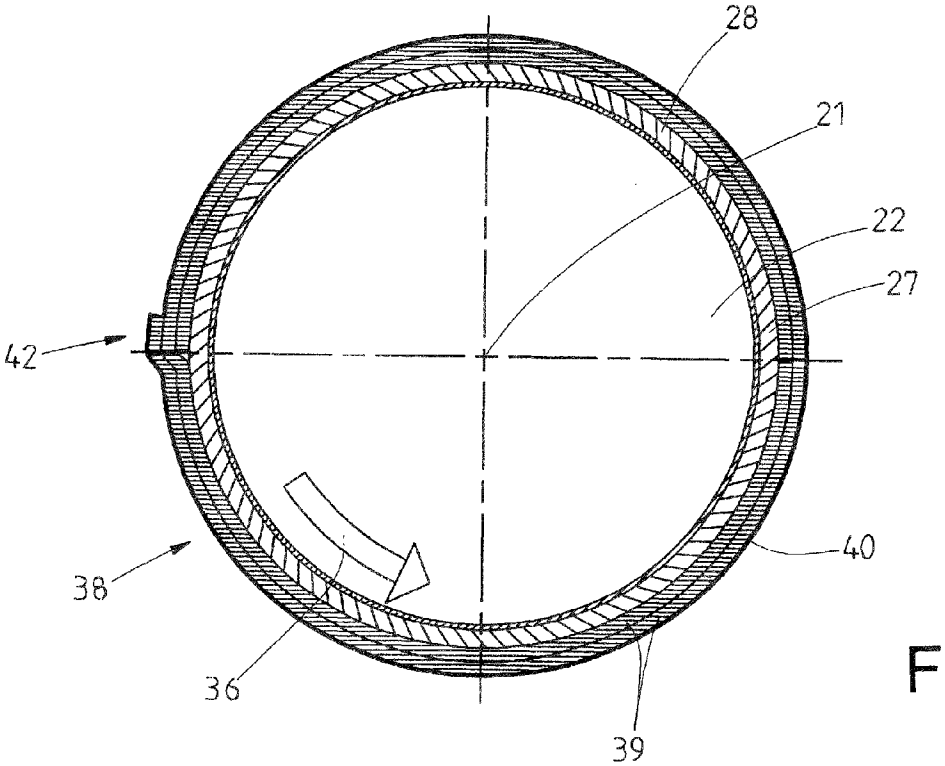
FIG. 4 shows a view analogous to FIG. 2 of a second exemplary embodiment of the spiral wrapping.
Figure 5:
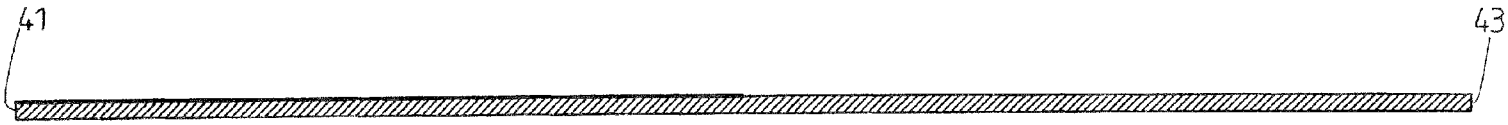
FIG. 5 shows a developed view of the spiral wrapping of the exemplary embodiment of FIG. 4.

FIGS. 4 and 5 show a single-part spiral wrapping 38 produced from a fiber layer 39 and a thinner outer layer 40. According to FIG. 5, a length of the fiber layer 39 corresponds to double the outer circumference of the ironer roller 22 or the outer side of the spring system 28 of the same. Contrary to this, a length of the outer layer 40, proceeding from a transverse edge 41, is shorter. The outer layer 40 is approximately only half the length of the fiber layer 39. This means that the length of the outer layer 40 corresponds approximately to the diameter of the ironer roller 22 or outer side of the spring system 28. Preferably, the length of the fiber layer 39 and of the outer layer 40 is somewhat longer than once around or twice around the circumference of the ironer roller 22. This small overlength serves for producing the overlap 42 which serves for connecting opposite transverse edges 41, 43 of the spiral wrapping 38.

Proceeding from the transverse edge 43 which does not have an outer layer 40 associated therewith, starting at the position of the overlap 42, the spiral wrapping 38 is placed twice around the ironer roller 22. Because the outer layer 40 is only half the length of the fiber layer 39, after being wrapped around the ironer roller 22 for the first time the fiber layer 39 on the outside is still free such that the second layer of the fiber layer 39, created when winding the spiral wrapping 38 around the ironer roller 22 for the second time, rests directly on the inside layer of the fiber layer 39. When the spiral wrapping 38 is wound around the ironer roller 22 for the second time, the outer layer 40 comes to rest on the outside of the spiral wrapping 38. Because a length of the outer layer 40 is preferably somewhat longer than the circumference of the ironer roller 22, the ironer roller 22 is completely surrounded by the outer layer 40 such that the outer layer 40 of the spiral wrapping 38 with a greater frictional value results in the respective item of laundry being entrained by the ironing roller 22 with a greater holding force or adhesive strength.

The transverse edge 41 of the spiral wrapping is connected to the transverse edge 43 in the region of the overlap 42 in the manner described in conjunction with the preceding exemplary embodiment. To this end it must be noted that, for reasons of representation, in the Figures the overlap 42 is shown thicker than it actually is. Once the spiral wrapping 38 has been produced, the overlap 42 is scarcely still present because it is pressed into the double layer soft fiber layer 39. This means that the laundry to be ironed is not impaired by the overlap 42 of the spiral wrapping 38 of the ironer roller 22.

Figure 6:
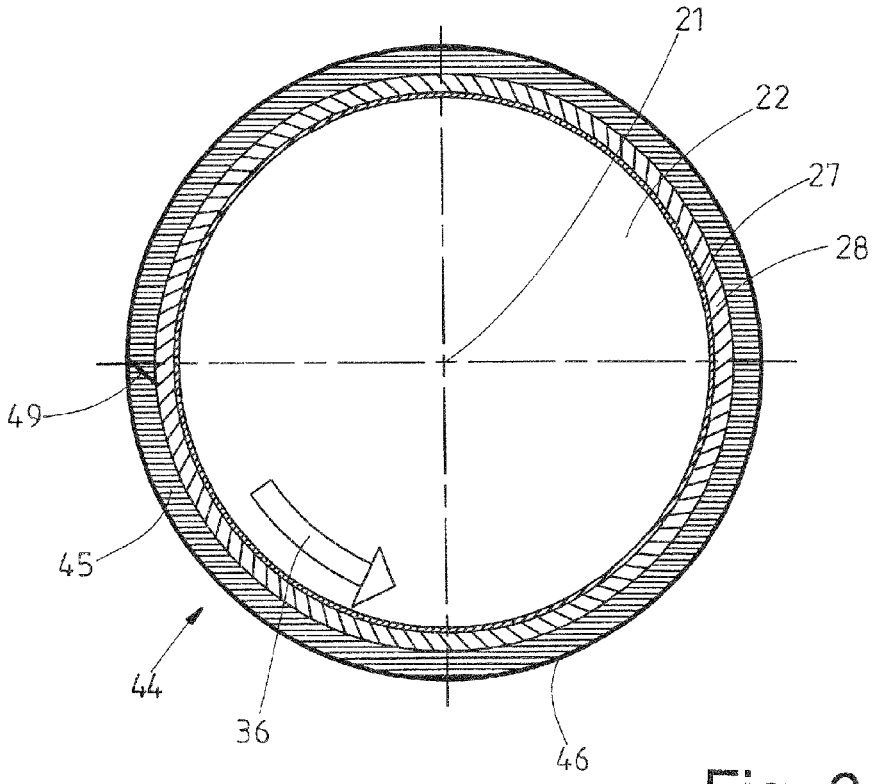
FIG. 6 shows a representation analogous to FIG. 2 of a third exemplary embodiment of the spiral wrapping.
Figure 7:
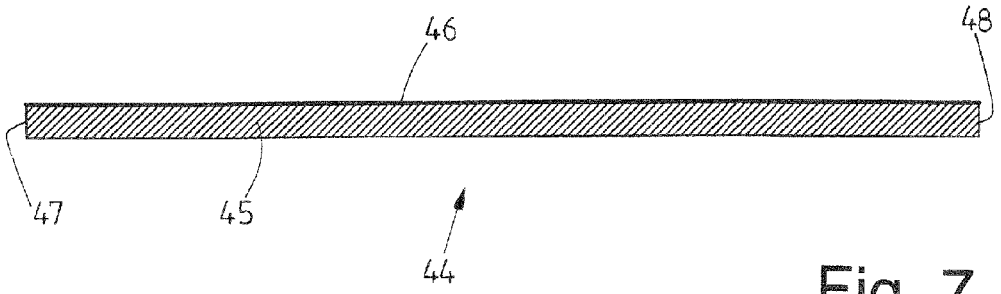
FIG. 7 shows a developed view of the spiral wrapping of FIG. 6.

FIGS. 6 and 7 show a spiral wrapping 44 according to a further exemplary embodiment of the invention. This is a single-part spiral wrapping 44 in this case too. The spiral wrapping 44 has a fiber layer 45 which is thicker, preferably twice as thick as in the case of the afore-described exemplary embodiments and an outer layer 46 which is connected thereto. The outer layer 46 completely covers the entire outer side of the fiber layer 45. As a result, the fiber layer 45 and the outer layer 46 are of identical length. Because the spiral wrapping 44 is only placed once around the ironer roller 22, the length of the spiral wrapping 44 with the fiber layer 45 and the outer layer 46 is as large as the circumference of the ironer roller 22, in particular the outer circumference of the spring system 28. The spiral wrapping 44 is placed once around the spring system 28 of the ironer roller 22 in such a manner that the outer layer 46 completely covers the fiber layer 45 on the outside and as a result surrounds the ironer roller 22 once completely.

The opposite transverse edges 47, 48 are not connected to an overlap seam on account of the thicker fiber layer 45, but by means of a butt seam 49, which is realized as a jointed butt seam 49 in the exemplary embodiment shown with transverse edges 47, 48 which are not radially directed but rather transverse edges 47, 48 which extend inclinedly with respect to the radial direction (FIG. 6).

Figure 8:
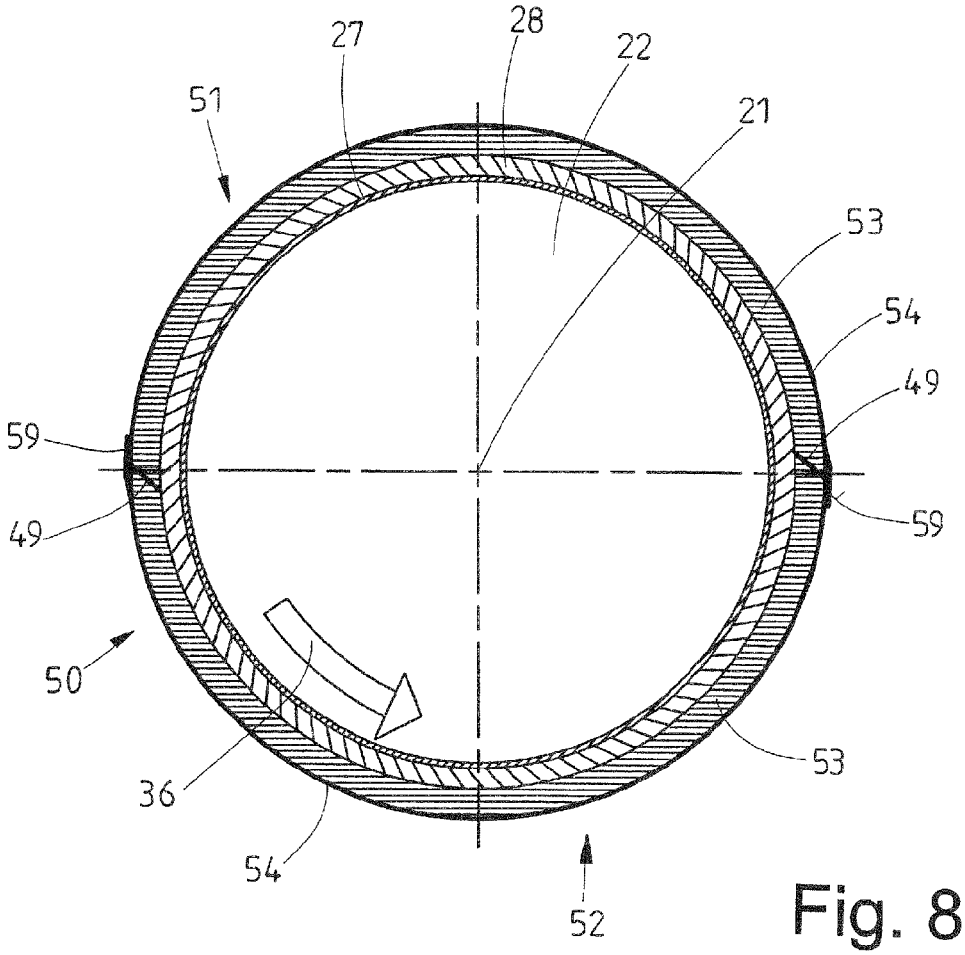
FIG. 8 shows a representation analogous to FIG. 2 of a fourth exemplary embodiment of the spiral wrapping.
Figure 9:
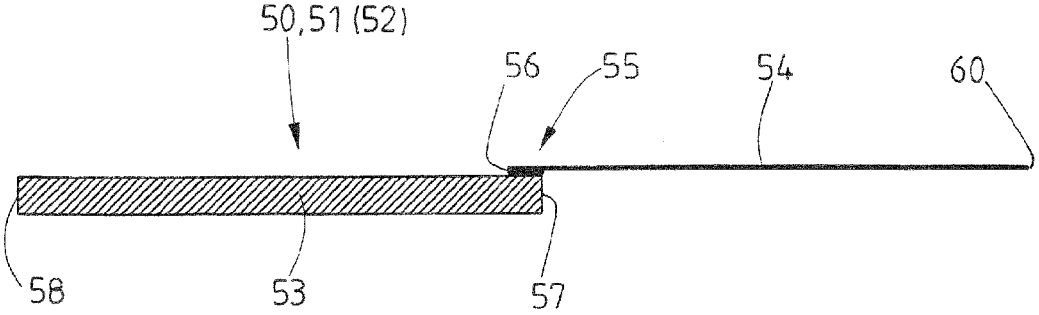
FIG. 9 shows a developed view of the spiral wrapping of FIG. 8.

FIGS. 8 and 9 show a spiral wrapping 50 according to a further alternative exemplary embodiment of the invention. Said spiral wrapping 50 only differs from the previously described spiral wrapping 44 in that it is realized in two parts, namely is assembled from two identical, in particular identically-sized spiral wrapping parts 51, 52. The fiber layer 53 of each spiral wrapping part 51 and 52 is relatively thick and corresponds approximately to the thickness of the fiber layer 45. This means that in the case of the spiral wrapping 50, the fiber layer 53 also surrounds the ironer roller 22 only once.

Each spiral wrapping part 51, 52, of which FIG. 9 shows the developed view of the spiral wrapping part 51, has an outer layer 54, which is connected to a region of the transverse edge 57 of the fiber layer 53 at a connecting point 55 in the region of a transverse edge 56, for example by means of sewing. The length of the fiber layer 53 and of the substantially thinner outer layer 54 with a comparatively large coefficient of friction is approximately the same, is namely in each case half the circumference of the ironer roller 22 or of the outer side of the spring system 28. However, contrary to the previous exemplary embodiments, the outer layer 54 is connected to the fiber layer 53 in the region of the overlap 55 in such a manner that the outer layer 54 does not cover the fiber layer 53, but is directed away from the fiber layer 53 (FIG. 9).

The two identical spiral wrapping parts 51 and 52, beginning with the free transverse edges 58 of the fiber layers 53, are placed around half the circumference of the ironer roller 22 in each case from diametrically opposite positions of the ironer roller 22, the outer layer 54 of the one spiral wrapping part 51 covering the outer side of the fiber layer 53 of the other spiral wrapping part 52. A continuous outer layer 54 over the entire circumference of the ironer roller 22 is thus brought about as a result of the two identical spiral wrapping parts 51, 52. The transverse edges 57, 58 of the fiber layers 53 of both spiral wrapping parts 51, 52 are connected together at diametrically opposite positions by way of butt seams 49, preferably jointed, such that the fiber layers 53 of the spiral wrapping parts 51, 52 follow one after the other in a substantially shoulder-free manner and enclose the ironer roller 22 seamlessly. The outer layers 54 of the spiral wrapping parts 51, 52 are connected to overlaps 59 in the regions of the butt seams 49 of the fiber layers 53. However, it is also conceivable to allow the free transverse edges 60 of the outer layers 54 in the region of the butt seams 49 to rest loosely on the connecting point 55 of the other spiral wrapping part 51, 52. This is effected such that as a result of the direction of rotation 36 of the ironer roller 22, the outer layers 54 are under tension and this means that the outer layer 54 of the one spiral wrapping part 51 automatically clings to the fiber layer 53 of the other spiral wrapping part 52 without it being necessary to connect the outer layers 54 to the respective fiber layer 53 over the entire area or at least at the transverse edges 60 for this purpose.

Figure 10:
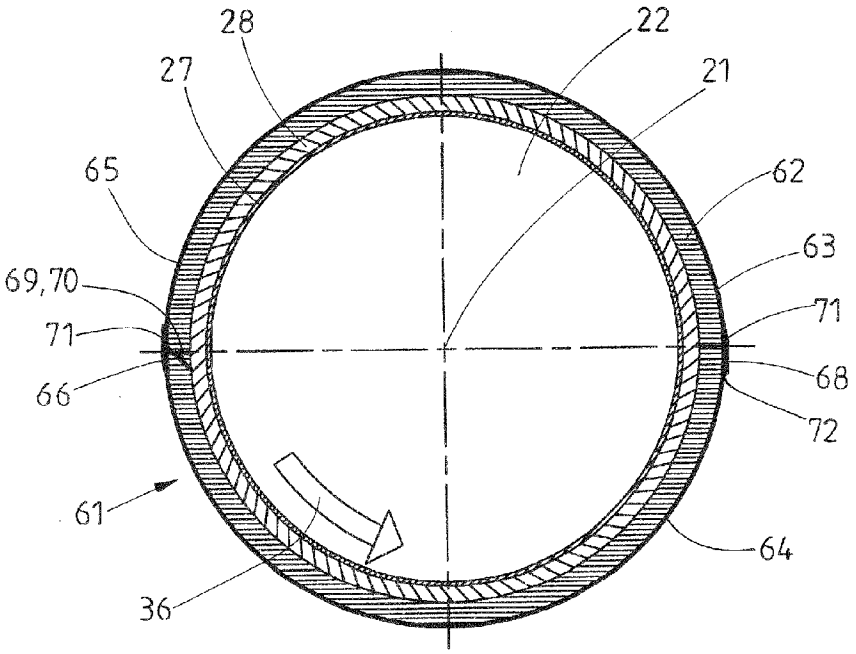
FIG. 10 shows a representation analogous to FIG. 2 of a fifth exemplary embodiment of the spiral wrapping.
Figure 11:
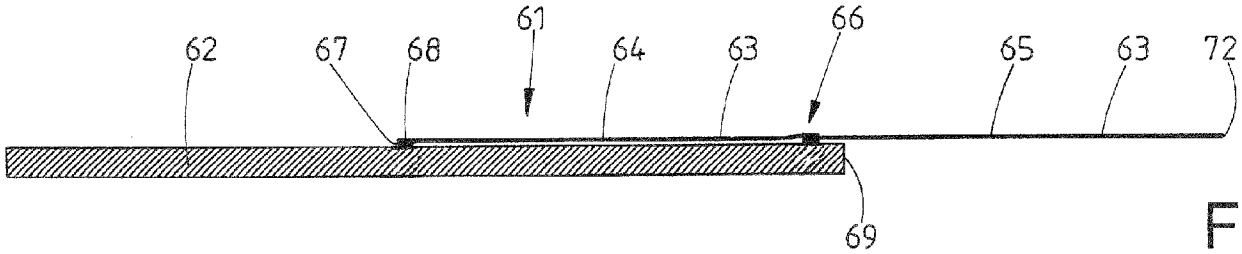
FIG. 11 shows a developed view of the spiral wrapping of FIG. 10.

FIGS. 10 and 11 show a spiral wrapping 61, which is realized in one part just as the spiral wrapping 44 of the exemplary embodiment of FIGS. 6 and 7 and is assembled from a single-layer, thick fiber layer 62 and a thinner outer layer 63 produced from a material with a relatively high coefficient of friction. A length of the fiber layer 62 corresponds to the circumference of the ironer roller 22. A length of the outer layer 63 also corresponds to the circumference of the ironer roller 22. However, the outer layer 63 is formed from two identical, in particular identically-sized outer layer parts 64 and 65 which are arranged one behind the other in the circumferential direction of the ironer roller 22 (FIG. 11). A length of each outer layer part 64 and 65 corresponds to half the circumference of the ironer roller 22. The outer layer parts 64 and 65 are connected together at a connecting point 66 on transverse edges which are directed towards each other. Said connecting point 66 can also be connected to the fiber layer 62. In addition, a free transverse edge 67 of the outer layer part 64 is connected at a connecting point 68 to the center of the fiber layer 62, that is to say approximately at half the length of the same. This means that the outer layer 63 is offset in relation to the fiber layer 62 about approximately half the circumference of the ironer roller 22. This means that only the outer layer part 64 overlaps half of the fiber layer 62, whilst the second outer layer part 65 protrudes with respect to the transverse edge 69 of the fiber layer 62 (FIG. 11).

To produce the spiral wrapping 61, said spiral wrapping is placed with the fiber layer 62 once around the outer surface 27 or the spring system 28 of the ironer roller 22 and opposite transverse edges 69 of the fiber layer 62 are connected together in a flush, preferably jointed manner by way of a butt seam 70. The outer layer 63, which is offset with respect to the fiber layer 62 about half the circumference of the ironer roller 22, is closed by an overlap 71 at a position of the circumference of the ironer roller 22 opposite the butt seam 70. This means that the outer layer 63, which is formed from the consecutive outer layer parts 64 and 65, surrounds the fiber layer 62 of the spiral wrapping 61 without a gap. As in the case of the exemplary embodiment of FIGS. 8 and 9, the free transverse edge 72 of the outer layer part 65, lying free before the spiral wrapping 61 is applied onto the ironer roller 22, does not need to be connected to the transverse edge 67 of the other outer layer part 64 in the region of the overlap 71. Rather, as a result of the rotating drive of the ironer roller 22 in the direction of the arrow 36, the outer layer part 65 automatically clings to the fiber layer 62 in the direction of rotation 36 as a result of the rotating drive of the ironer roller 22.

Figure 12:
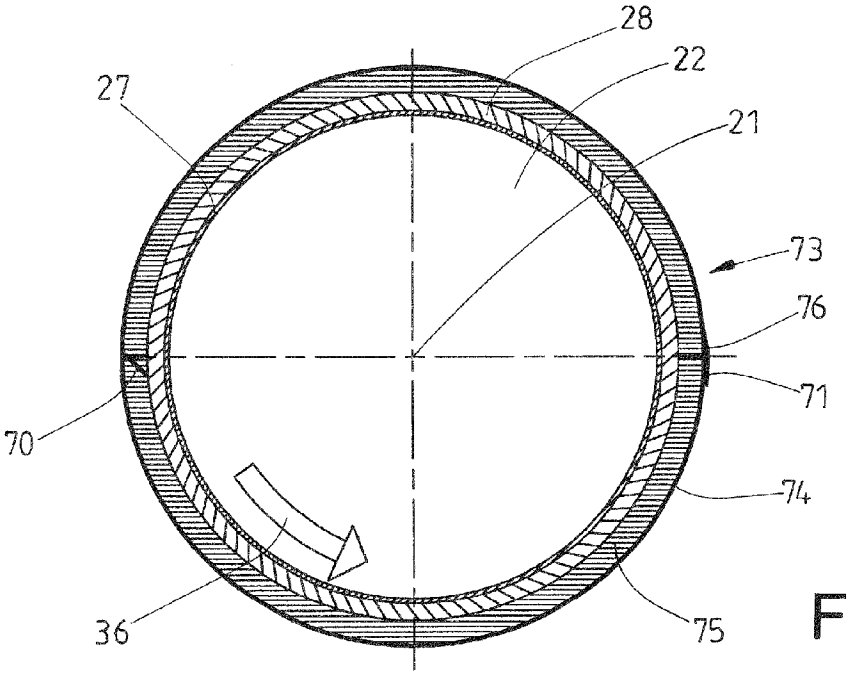
FIG. 12 shows a representation analogous to FIG. 2 of a sixth exemplary embodiment of the spiral wrapping.
Figure 13:
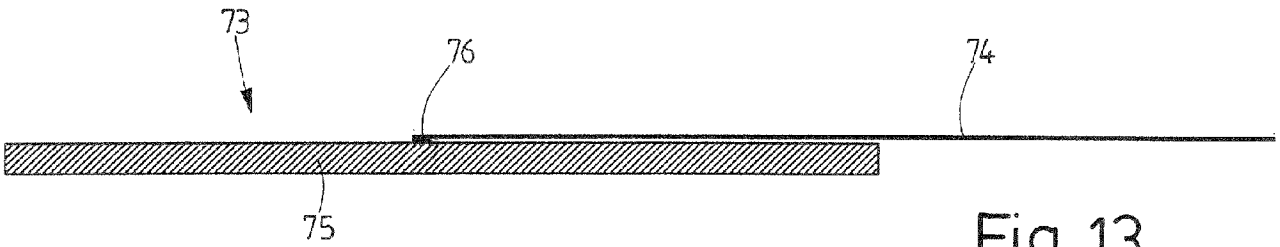
FIG. 13 shows a developed view of the spiral wrapping of FIG. 12.

The exemplary embodiment of FIGS. 12 and 13 shows a spiral wrapping 73 which only differs from the spiral wrapping 61 of FIGS. 10 and 11 in that the outer layer 74 is in one part. A length of both the outer layer 74 and the comparatively thick fiber layer 75, as in the case of the afore-described exemplary embodiment, corresponds to the circumference of the ironer roller 22. The outer layer 74 is also connected to the fiber layer 75 at the connecting point 76 by way of an offset, which corresponds approximately to half the length of the fiber layer 75. Once the spiral wrapping 73 has been placed around the ironer roller 22, the design of the spiral wrapping 73 is comparable to that of the spiral wrapping 61. All that is missing is the connecting point 66, which covers the butt seam 70 of the fiber layer 75 on the outside, between the two outer layer parts 64, 65 present in the case of the exemplary embodiment of FIGS. 10 and 11.

All the spiral wrappings 29, 38, 44, 50, 61, 73 are produced from preferably identical material combinations. The thicker fiber layers 30, 39, 45, 53, 62, 75 usually consist of a felt, in particular a needled felt, or also a nonwoven fabric made from thermally stable plastics material fibers, for example aramid fibers.

The outer layer 31, 40, 46, 54, 63, 74, which has only 1/10 of the ½ of the thickness of the fiber layer 30, 39, 45, 53, 62, 75, is formed from a woven fabric, in particular a coarse woven fabric. Such a woven fabric, in particular a coarse woven fabric, has a higher frictional value or coefficient of friction than felt or needled felt, from which the respective fiber layer 30, 39, 45, 53, 62 or 75 is formed. This means that the items of laundry to be ironed grip better to the spiral wrapping 29, 38, 44, 50, 61, 73 of the ironer roller 22 and do not slip so easily on the outside layers. The frictional engagement or grip between the items of laundry and the ironer roller 22 is improved in this manner, as a result of which the items of laundry are able to be moved past the smoothing surface 24 of the ironer bed 23 through the ironer gap 26 by the rotating ironer roller 22 in a more reliable manner, even when the ironer roller 22 is pressed at a relatively strong pressing force against or into the ironer bed 23. Above all it has been shown that by forming the outer layers 31, 40, 46, 54, 63 and 74 from a woven fabric, in particular a coarse woven fabric, as the age of the spiral wrapping 29, 38, 44, 50, 61, 73 increases, the coefficient of friction does not change or does not change as severely as was the case with previous spiral wrappings 29, 38, 44, 50, 61, 73 produced from only the fiber layer 30, 39, 45, 53, 62, 75.

The material for the woven fabric, in particular coarse woven fabric, of the outer layer 31, 40, 46, 54, 63, 74 is preferably thermally stable. Thermally stable plastics material fibers which, where applicable, can also be aramid fibers, are particularly suitable. The cross sections of the fibers for forming the woven fabric or coarse woven fabric of the outer layer 31, 40, 46, 54, 63, 74 can be arbitrary. The cross sections of the fibers are preferably out-of-true.

Wherever transverse edges of the outer layers 31, 40, 46, 54, 63, 74 are sewed up to the fiber layers 30, 39, 45, 53, 62, 75, plastics material threads or fibers with a smooth surface, for example made of polytetrafluoroethylene, are used as threads for the seam.

List Of References

20 Chest ironer
21 Axis of rotation
22 Ironer roller
23 Ironer bed
24 Smoothing surface
25 Surface area
26 Ironer gap
27 Outer surface
28 Spring system
29 Spiral wrapping
30 Fiber layer
31 Outer layer
32 Spiral wrapping part
33 Spiral wrapping part
34 Overlap
35 Transverse edge
36 Arrow
37 Transverse edge
38 Spiral wrapping
39 Fiber layer
40 Outer layer
41 Transverse edge
42 Overlap
43 Transverse edge
44 Spiral wrapping
45 Fiber layer
46 Outer layer
47 Transverse edge
48 Transverse edge
49 Butt seam
50 Spiral wrapping
51 Spiral wrapping part
52 Spiral wrapping part
53 Fiber layer
54 Outer layer
55 Connecting point
56 Transverse edge
57 Transverse edge
58 Transverse edge
59 Overlap
60 Free transverse edge
61 Spiral wrapping
62 Fiber layer
63 Outer layer
64 Outer layer part
65 Outer layer part
66 Connecting point
67 Free transverse edge
68 Connecting point
69 Transverse edge
70 Butt seam
71 Overlap
72 Free transverse edge
73 Spiral wrapping
74 Outer layer
75 Fiber layer
76 Connecting point

What is claimed is:

1. A spiral wrapping for an ironer roller (22) of a chest ironer (20), said spiral wrapping comprising a fiber layer (30, 39, 45, 53, 62, 75) which is arranged at least in one layer around the ironer roller (22) or around a spring system (28) which is supported by the ironer roller (22), wherein an uncovered outer side of the fiber layer (30, 39, 45, 53, 62, 75) has associated therewith an outer layer (31, 40, 46, 54, 63, 74) with a coefficient of friction which is greater in comparison with that of the fiber layer (30, 39, 45, 53, 62, 75).

2. The spiral wrapping according to claim 1, wherein at least one transverse edge of the outer layer (31, 40, 46, 54, 63, 74) which extends parallel to the axis of rotation (21) of the ironer roller (22) is connected to the fiber layer (30, 39, 45, 53, 62, 75).

3. The spiral wrapping according to claim 1, wherein at least one transverse edge of the outer layer (31, 40, 46, 54, 63, 74) which extends parallel to the axis of rotation (21) of the ironer roller (22) is sewn up with the fiber layer (30, 39, 45, 53, 62, 75) using plastics material threads.

4. The spiral wrapping according to claim 1, wherein the outer layer (31, 40, 46, 54, 63, 74) is connected at least in part to the fiber layer (30, 39, 45, 53, 62, 75) over the entire surface.

5. The spiral wrapping according to claim 1, wherein the outer layer (31, 40, 46, 54, 63, 74) has a length that is only half that of the fiber layer (30, 39, 45, 53, 62, 75).

6. The spiral wrapping according to claim 1, wherein the fiber layer (30, 39, 45, 53, 62, 75) and the outer layer (31, 40, 46, 54, 63, 74) are approximately the same length.

7. The spiral wrapping according to claim 1, wherein said spiral wrapping is composed of several identically-sized spiral wrapping parts (32, 33; 51, 52).

8. The spiral wrapping according to claim 7, wherein the fiber layer (30, 53) has a length that is dimensioned such that the fiber layer (30, 53) of the spiral wrapping parts (32, 33; 51, 52) completely surrounds the ironer roller (22), but the outer layer (31, 54) corresponds only to part of the length of the fiber layer (30, 53).

9. The spiral wrapping according to claim 7, wherein the fiber layer (30, 53) has a length and the length of the fiber layer (30, 53) of each of the spiral wrapping parts (32, 33; 51, 52) is such that the fiber layer (30, 53) only partially surrounds the ironer roller (22) and the outer layer (31, 54) corresponds to the length of the fiber layer (30, 53).

10. The spiral wrapping according to claim 1, wherein the fiber layer (39) has a length that corresponds approximately to double the circumference of the ironer roller (22) and the outer layer (40) extends only over half the length of the fiber layer (39).

11. The spiral wrapping according to claim 1, wherein the outer layer (31, 40, 46, 54, 63, 74) is formed from a woven fabric.

12. The spiral wrapping according to claim 11, wherein the outer layer (31, 40, 46, 54, 63, 74) is formed from a coarse woven fabric produced from plastics material.

13. The spiral wrapping according to claim 1, wherein the outer layer (31, 40, 46, 54, 63, 74) is thinner than the fiber layer (30, 39, 45, 53, 62, 75).

14. A chest ironer for smoothing out items of laundry, said chest ironer comprising at least one ironer roller (22) which has a cylindrical surface area and one ironer bed (23) associated with each ironer roller (22), wherein the surface area of the respective ironer roller (22) is provided with an outer spiral wrapping (29, 38, 44, 50, 61, 73) and a spring system (28) which has springs is provided, where applicable, between the surface area of the respective ironer roller (22) and the spiral wrapping (29, 38, 44, 50, 61, 73), wherein the spiral wrapping (29, 38, 44, 50, 61, 73) is formed from a fiber layer (30, 39, 45, 59, 62, 75) and an outer layer (31, 40, 46, 54, 63, 74) which covers said fiber layer on the outside and has a coefficient of friction which is greater than that of the fiber layer (30, 39, 45, 53, 62, 75).

15. The chest ironer according to claim 14, wherein at least one transverse edge of the outer layer (31, 40, 46, 54, 63, 74) which extends parallel to the axis of rotation (21) of the ironer roller (22) is connected to the fiber layer (30, 39, 45, 53, 62, 75).

16. The chest ironer according to claim 14, wherein at least one transverse edge of the outer layer (31, 40, 46, 54, 63, 74) which extends parallel to the axis of rotation (21) of the ironer roller (22) is sewn up with the fiber layer (30, 39, 45, 53, 62, 75) using plastics material threads.

17. The chest ironer according to claim 14, wherein the outer layer (31, 40, 46, 54, 63, 74) is connected at least in part to the fiber layer (30, 39, 45, 53, 62, 75) over the entire surface.

18. The chest ironer according to claim 14, wherein the outer layer (31, 40, 46, 54, 63, 74) has a length that is only half that of the fiber layer (30, 39, 45, 53, 62, 75).

19. The spiral wrapping according to claim 14, wherein the fiber layer (30, 39, 45, 53, 62, 75) and the outer layer (31, 40, 46, 54, 63, 74) are approximately the same length.

20. The chest ironer according to claim 14, wherein said spiral wrapping is composed of several identically-sized spiral wrapping parts (32, 33; 51, 52).

21. The chest ironer according to claim 20, wherein the fiber layer (30, 53) has a length that is dimensioned such that the fiber layer (30, 53) of the spiral wrapping parts (32, 33; 51, 52) completely surrounds the ironer roller (22), but the outer layer (31, 54) corresponds only to part of the length of the fiber layer (30, 53).

22. The chest ironer according to claim 20, wherein the fiber layer (30, 53) has a length and the length of the fiber layer (30, 53) of each of the spiral wrapping parts (32, 33; 51, 52) is such that the fiber layer (30, 53) only partially surrounds the ironer roller (22) and the outer layer (31, 54) corresponds to the length of the fiber layer (30, 53).

23. The chest ironer according to claim 14, wherein the fiber layer (39) has a length that corresponds approximately to double the circumference of the ironer roller (22) and the outer layer (40) extends only over half the length of the fiber layer (39).

24. The chest ironer according to claim 14, wherein the outer layer (31, 40, 46, 54, 63, 74) is formed from a woven fabric.

25. The chest ironer according to claim 24, wherein the outer layer (31, 40, 46, 54, 63, 74) is formed from a coarse woven fabric produced from plastics material.

26. The chest ironer according to claim 14, wherein the outer layer (31, 40, 46, 54, 63, 74) is thinner than the fiber layer (30, 39, 45, 53, 62, 75).

* * * * *